US009510645B2

(12) United States Patent
Avar et al.

(10) Patent No.: US 9,510,645 B2
(45) **Date of Patent: *Dec. 6, 2016**

(54) ARTICLE OF FOOTWEAR WITH MULTI-DIRECTIONAL SOLE STRUCTURE

(71) Applicant: Nike, Inc., Beaverton, OR (US)

(72) Inventors: Eric P. Avar, Lake Oswego, OR (US); Aaron A C Cooper, Portland, OR (US); David J. Dirsa, North Andover, MA (US); Thomas Foxen, Portland, OR (US); Tom Luedecke, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 456 days.

This patent is subject to a terminal disclaimer.

(21) Appl. No.: 13/936,396

(22) Filed: Jul. 8, 2013

(65) Prior Publication Data

US 2014/0007459 A1 Jan. 9, 2014

Related U.S. Application Data

(62) Division of application No. 12/474,844, filed on May 29, 2009, now Pat. No. 8,505,219.

(51) Int. Cl.

| | |
|---|---|
| ***A43B 1/10*** | (2006.01) |
| ***A43B 13/14*** | (2006.01) |
| ***A43B 5/06*** | (2006.01) |
| ***A43B 13/16*** | (2006.01) |
| ***A43B 13/18*** | (2006.01) |
| ***A43B 13/22*** | (2006.01) |

(52) U.S. Cl.

CPC ..... *A43B 13/141* (2013.01); *A43B 5/06* (2013.01); *A43B 13/16* (2013.01); *A43B 13/181* (2013.01); *A43B 13/223* (2013.01)

(58) Field of Classification Search

CPC ..... A43B 5/06; A43B 13/141; A43B 13/16; A43B 13/181; A43B 13/223

USPC ..... 36/102, 25 R, 31, 59 C; D2/951–960

See application file for complete search history.

(56) References Cited

U.S. PATENT DOCUMENTS

| | | | | |
|---|---|---|---|---|
| 39,747 | A * | 9/1863 | McKenna | B27L 11/04 144/186 |
| 16,757 | A | 6/1886 | Cowen | |
| 354,693 | A | 12/1886 | Dick | |
| D39,747 | S | 1/1909 | McKenna | |
| 1,111,437 | A | 9/1914 | Butterfield | |
| D46,568 | S | 10/1914 | Hopwood | |
| D78,502 | S | 5/1929 | Blair | |
| D79,934 | S | 11/1929 | Paterson | |
| 1,808,063 | A | 6/1931 | Paterson | |
| 1,818,063 | A | 8/1931 | Huffman | |

(Continued)

FOREIGN PATENT DOCUMENTS

| | | |
|---|---|---|
| DE | 3741444 | 7/1988 |

*Primary Examiner* — Jila M Mohandesi

(74) *Attorney, Agent, or Firm* — Banner & Witcoff, Ltd.

(57) ABSTRACT

An article of footwear with a multi-directional sole structure including a flex groove system is disclosed. The flex groove system includes a plurality of longitudinal flex grooves and lateral flex grooves that divide the sole structure into a plurality of segments. The flex groove system also includes a plurality of diagonal flex grooves that intersect the corners of the plurality of segments. The flex grooves system can provide enhanced flexibility for the sole structure and can enhance multi-directional flexing.

20 Claims, 7 Drawing Sheets

(56) References Cited

U.S. PATENT DOCUMENTS

| | | | | | |
|---|---|---|---|---|---|
| 1,936,729 | A | | 11/1933 | Mebane | |
| D278,851 | S | | 5/1985 | Austin | |
| D302,352 | S | | 7/1989 | Austin | |
| D326,181 | S | * | 5/1992 | Katz | D2/960 |
| D332,863 | S | | 2/1993 | Lucas | |
| D337,876 | S | | 8/1993 | Kilbey | |
| D377,859 | S | | 2/1997 | Bramani | |
| D378,472 | S | | 3/1997 | Bramani | |
| D409,362 | S | | 5/1999 | Turner et al. | |
| D426,054 | S | * | 6/2000 | Mazars | D2/947 |
| D427,758 | S | | 7/2000 | Schneider | |
| D439,394 | S | | 3/2001 | Akhidime | |
| D468,079 | S | | 1/2003 | DeGrand et al. | |
| D469,949 | S | | 2/2003 | Koo | |
| D483,934 | S | | 12/2003 | Adams et al. | |
| D507,399 | S | * | 7/2005 | White | D2/951 |
| D519,265 | S | | 4/2006 | Gerber | |
| D532,585 | S | | 11/2006 | McDonald | |
| D536,517 | S | | 2/2007 | Gerber | |
| D548,439 | S | | 8/2007 | McClaskie | |
| D549,941 | S | | 9/2007 | Dirsa | |
| D554,339 | S | | 11/2007 | Reina et al. | |
| 7,290,357 | B2 | | 11/2007 | McDonald et al. | |
| D564,191 | S | | 3/2008 | Jensen | |
| D577,883 | S | | 10/2008 | Link | |
| D580,139 | S | * | 11/2008 | McClaskie | D2/951 |
| 8,505,219 | B2 | | 8/2013 | Avar et al. | |
| 2008/0229617 | A1 | | 9/2008 | Johnson et al. | |
| 2010/0299965 | A1 | | 12/2010 | Avar et al. | |

* cited by examiner

ARTICLE OF FOOTWEAR WITH MULTI-DIRECTIONAL SOLE STRUCTURE

CROSS-REFERENCE TO RELATED APPLICATION(S)

This application is a Divisional of U.S. application Ser. No. 12/474,844, entitled "Article of Footwear With Multi-Directional Sole Structure," filed on May 29, 2009, and published as U.S. Patent Application Publication Number 2010/0299965. U.S. application Ser. No. 12/474,844 is herein incorporated by reference in its entirety.

BACKGROUND

The present invention relates to an article of footwear, and in particular to a sole for footwear.

Articles of footwear including flex grooves have been previously proposed. Johnson et al. (U.S. patent application publication number 2008/0229617) teaches an article of footwear having a sole structure with an articulated midsole and outsole. Johnson teaches an outsole forming projections that extend into the indentations of the midsole and the outsole has grooves located opposite of the projections.

McDonald et al. (U.S. Pat. No. 7,290,357) also teaches an article of footwear with an articulated sole structure. McDonald teaches sole elements defining a lower surface for the sole and the sole elements are separated by a plurality of sipes that extend upward from the lower surface and into the sole structure. McDonald also teaches that the outsole may be located within the sipes and extend between the sole elements.

The related art lacks provisions for enhancing the flexibility of a sole in multiple different directions. There is a need in the art for an article that addresses the shortcomings of the related art.

SUMMARY

The invention discloses an article of footwear with a multi-directional sole structure. In one aspect, the invention provides an article of footwear, comprising: a sole structure including a longitudinal direction associated with a length of the sole structure and the sole structure including a lateral direction associated with a width of the sole structure; a first longitudinal flex groove and a second longitudinal flex groove extending in the longitudinal direction and wherein the second longitudinal flex groove is disposed adjacent to the first longitudinal flex groove with no other longitudinal flex groove disposed between the first longitudinal flex groove and the second longitudinal flex groove; a first lateral flex groove and a second lateral flex groove extending in the lateral direction and wherein the first lateral flex groove is disposed adjacent to the second lateral flex groove with no other lateral flex grooves disposed between the first lateral flex groove and the second lateral flex groove; the first longitudinal flex groove intersecting the first lateral flex groove at a first intersection and the second longitudinal flex groove intersecting the second lateral flex groove at a second intersection; a diagonal flex groove, the diagonal flex groove being oriented in a direction between the longitudinal direction and the lateral direction; and where a first portion of the diagonal flex groove extends from the first intersection to the second intersection.

In another aspect, the invention provides an article of footwear, comprising: a sole structure including a longitudinal direction associated with a length of the sole structure and the sole structure including a lateral direction associated with a width of the sole structure; a longitudinal flex groove extending in the longitudinal direction; a first lateral flex groove and a second lateral flex groove extending in the lateral direction; the first longitudinal flex groove intersecting the first lateral flex groove at a first intersection; the second lateral flex groove including an end portion disposed on an edge of the sole structure; a diagonal flex groove, the diagonal flex groove being oriented in a direction between the longitudinal direction and the lateral direction; and wherein the diagonal flex groove extends from the first intersection to the end portion of the second lateral flex groove.

In another aspect, the invention provides an article of footwear, comprising: a sole structure including a longitudinal direction associated with a length of the sole structure and the sole structure including a lateral direction associated with a width of the sole structure; a first longitudinal flex groove and a second longitudinal flex groove extending in the longitudinal direction and wherein the second longitudinal flex groove is disposed adjacent to the first longitudinal flex groove with no other longitudinal flex groove disposed between the first longitudinal flex groove and the second longitudinal flex groove; a first lateral flex groove and a second lateral flex groove extending in the lateral direction and wherein the first lateral flex groove is disposed adjacent to the second lateral flex groove with no other lateral flex grooves disposed between the first lateral flex groove and the second lateral flex groove; a segment bounded by the intersections of the first longitudinal flex groove with the first lateral flex groove and the second lateral flex groove and by the intersections of the second longitudinal flex groove with the first lateral flex groove and the second lateral flex groove; a cross-like pattern comprising a first diagonal flex groove and a second diagonal flex groove; and wherein end portions of the cross-like pattern extend to the intersections between the first longitudinal flex groove, the second longitudinal flex groove, the first lateral flex groove and the second lateral flex groove.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
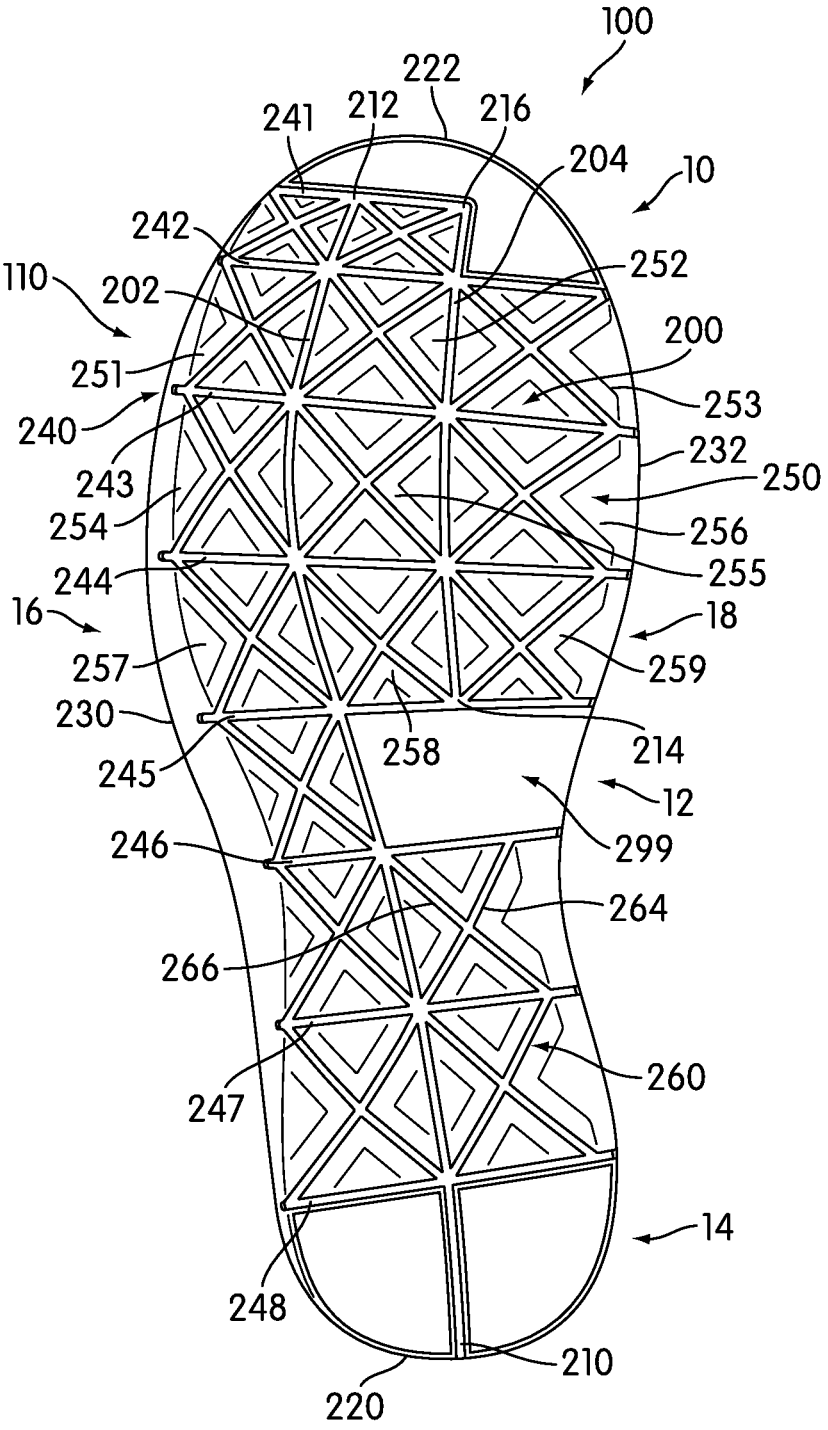
FIG. 1 is a plan view of an embodiment of an article of footwear including a sole structure with a flex groove system.

FIG. 1 illustrates an exemplary embodiment of article of footwear 100. In particular, FIG. 1 is a plan view of an exemplary embodiment of article of footwear 100. For clarity, the following detailed description discusses an exemplary embodiment, in the form of a sports shoe, but it should be noted that the present invention could take the form of any article of footwear including, but not limited to: hiking boots, soccer shoes, football shoes, sneakers, rugby shoes, basketball shoes, baseball shoes as well as other kinds of shoes. As shown in FIG. 1, article of footwear 100, also referred to simply as article 100, is intended to be used with a right foot; however, it should be understood that the following discussion may equally apply to a mirror image of article of footwear 100 that is intended for use with a left foot.

For purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves. In addition, forefoot portion 10, midfoot portion 12 and heel portion 14, as well as lateral side 16 and medial side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole.

Article 100 can include an upper (not shown) and sole structure 110. Sole structure 110 is secured to the upper and extends between the foot and the ground when article 100 is worn. In different embodiments, sole structure 110 may include different components. For example, sole structure 110 may include an outsole, a midsole, and/or an insole. In some cases, one or more of these components may be optional.

Generally, an upper used with article 100 may be any type of upper. In particular, the upper could have any design, shape, size and/or color. For example, in embodiments where article 100 is a basketball shoe, the upper could be a high top upper that is shaped to provide high support on an ankle. In embodiments where article 100 is a running shoe, the upper could be a low top upper.

In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Article 100 may be made from materials known in the art for making articles of footwear. For example, sole structure 110 may be made from any suitable material, including, but not limited to: elastomers, siloxanes, natural rubber, other synthetic rubbers, aluminum, steel, natural leather, synthetic leather, or plastics. Also, an upper may be made from any suitable material, including, but not limited to: nylon, natural leather, synthetic leather, natural rubber or synthetic rubber.

An article of footwear can include provisions for enhancing the flexibility of a sole. In some cases, the materials used for making a sole may be substantially flexible. In other cases, a sole can be provided with structural features that facilitate flexibility. In an exemplary embodiment, a sole can be provided with a flex groove system that provides flexibility in a variety of directions.

Sole structure 110 can include flex groove system 200. Generally, flex groove system 200 can include a plurality of flex grooves disposed on one or more portions of sole structure 110. In some cases, flex groove system 200 may be associated with forefoot portion 10 of sole structure 110. In other cases, flex groove system 200 may be associated with midfoot portion 12 of sole structure 110. In still other cases, flex groove system 200 may be associated with heel portion 14 of sole structure 110. In an exemplary embodiment, flex groove system 200 may be configured to extend through forefoot portion 10, midfoot portion 12 and heel portion 14 of sole structure 110.

Generally, each flex groove of flex groove system 200 may be oriented in any direction. In some cases, flex groove system 200 can include flex grooves that are oriented in a substantially longitudinal direction. In other cases, flex groove system 200 can include flex grooves that are oriented in a substantially lateral direction. In still other cases, flex groove system 200 can include flex grooves that are oriented in a direction between the longitudinal direction and the lateral direction. For example, some embodiments can include one or more diagonally oriented flex grooves.

In some embodiments, flex groove system 200 can be provided with one or more longitudinal flex grooves. In some cases, flex groove system 200 can include one longitudinal flex groove. In other cases, flex groove system 200 can include two or more longitudinal flex grooves. In an exemplary embodiment, flex groove system 200 can include two longitudinal flex grooves.

Flex groove system 200 can include first longitudinal flex groove 202 and second longitudinal flex groove 204. In some cases, first longitudinal flex groove may extend from heel portion 14 to forefoot portion 10. In particular, first longitudinal flex groove 202 may include first end portion 210 that is disposed on rearward edge 220 of heel portion 14. In addition, first longitudinal flex groove 202 may include second end portion 212 that is disposed adjacent to forward edge 222 of forefoot portion 10. In some cases, second longitudinal flex groove 204 may extend only through forefoot portion 10. In particular, second longitudinal flex groove 204 may include first end portion 214 that is disposed adjacent to midfoot portion 12. In addition, second longitudinal flex groove 204 may include second end portion 216 that is disposed adjacent to forward edge 222 of forefoot portion 10. With this arrangement, first longitudinal flex groove 202 and second longitudinal flex groove 204 can provide substantial flexibility for sole structure 110 about a longitudinal axis of article 100.

In different embodiments, the shape of a longitudinal flex groove can vary. In some cases, a longitudinal flex groove can have a curved or contoured shape. In other cases, a longitudinal flex groove can have a substantially straight shape. In the current embodiment, first longitudinal flex groove 202 may have a contoured shape that curves in a manner similar to lateral edge 230 of sole structure 110. Also, second longitudinal flex groove 204 can have an approximately straight shape. By varying the shapes of one or more longitudinal flex grooves, the lateral flexibility of sole structure 110 can be fine tuned.

In some embodiments, flex groove system 200 can be provided with one or more lateral flex grooves. In some cases, flex groove system 200 can include one lateral flex groove. In other cases, flex groove system 200 can include two or more lateral flex grooves. In an exemplary embodiment, flex groove system 200 can include eight lateral flex grooves.

Flex groove system 200 can include lateral flex groove set 240 that comprises first lateral flex groove 241, second lateral flex groove 242, third lateral flex groove 243, fourth lateral flex groove 244, fifth lateral flex groove 245, sixth lateral flex groove 246, seventh lateral flex groove 247 and eighth lateral flex groove 248. In some cases, each flex groove of lateral flex groove set 240 may extend from lateral edge 230 of sole structure 110 to medial edge 232 of sole structure 110. In other words, each flex groove of lateral flex groove set 240 may extend over the entire width of sole structure 110. Here it will be understood that the width of sole structure 110 varies from forefoot portion 10 to heel portion 14 and so each flex groove may extend over the local width of sole structure 110 according to the location of the particular flex groove. For example, third flex groove 243, which is located in forefoot portion 10 may be wider than seventh flex groove 247, which is located in heel portion 14. In other embodiments, one or more flex grooves of lateral flex groove set 240 may not extend over the entire width of sole structure 110, stopping short of medial edge 232 of sole structure 110. With this arrangement, the flex grooves of lateral flex groove set 240 can provide substantial flexibility for sole structure 110 about a lateral axis of article 100.

In some embodiments, flex groove system 200 can be configured to divide sole structure 110 into a plurality of segments. In an exemplary embodiment, the intersection of first longitudinal flex groove 202 and second longitudinal flex groove 204 with lateral flex groove set 240 may divide sole structure 110 into plurality of segments 250. For example, the intersection of first longitudinal flex groove 202 and second longitudinal flex groove 204 with second flex groove 242 and third flex groove 243 may divide sole structure 110 into first segment 251, second segment 252 and third segment 253. Likewise, the intersection of first longitudinal flex groove 202 and second longitudinal flex groove 204 with third lateral flex groove 243 and fourth lateral flex groove 244 may divide sole structure 110 into fourth segment 254, fifth segment 255 and sixth segment 256. Similarly, the intersection of first longitudinal flex groove 202 and second longitudinal flex groove 204 with fourth lateral flex groove 244 and fifth lateral flex groove 245 may divide sole structure 110 into seventh segment 257, eighth segment 258 and ninth segment 259. In a similar manner, each segment of plurality of segments 250 may be bounded by multiple flex grooves of flex groove system 200 as well as edges of sole structure 110. With this arrangement, bottom surface 299 of sole structure 110 can be provided with segments that are configured to flex substantially independently of one another.

In different embodiments, the shape of each segment of plurality of segments 250 can vary. In some cases, all the segments of plurality of segments 250 can have substantially similar shapes. In other cases, each segment of plurality of segments 250 can have different shapes. Examples of different shapes for segments include, but are not limited to: rectangular shapes, rounded shapes, polygonal shapes, regular shapes, irregular shapes as well as any other types of shapes. In an exemplary embodiment, a majority of the segments of plurality of segments 250 may have an approximately rectangular shape.

A flex groove system can include provisions for increasing multi-directional flexibility for a sole structure. In some cases, a flex groove system can include a plurality of flex grooves extending in directions between the longitudinal and lateral directions. For example, in one embodiment, a flex groove system can include a plurality of diagonally oriented flex grooves.

In some embodiments, flex groove system 200 can be provided with one or more diagonal flex grooves. In some cases, flex groove system 200 can include one diagonal flex groove. In other cases, flex groove system 200 can include two or more diagonal flex grooves. In an exemplary embodiment, flex groove system 200 can include between 10 and 25 diagonal flex grooves.

In some embodiments, flex groove system 200 can be provided with plurality of diagonal flex grooves 260. In particular, each groove of plurality of diagonal flex grooves 260 may be oriented in a direction between the longitudinal direction and the lateral direction. In some cases, plurality of diagonal flex grooves 260 may extend through forefoot portion 10. In other cases, plurality of diagonal flex grooves 260 may extend through midfoot portion 12. In still other cases, plurality of diagonal flex grooves 260 may extend through heel portion 14. In an exemplary embodiment, plurality of diagonal flex grooves 260 may extend through forefoot portion 10, midfoot portion 12 and heel portion 14.

In different embodiments, each groove of plurality of diagonal flex grooves 260 can be oriented in various directions. In some cases, some grooves of plurality of diagonal flex grooves 260 can be disposed at an angle in a range between 0 and 90 degrees from a lateral axis. In other cases, some grooves of plurality of diagonal flex grooves 260 can be disposed at an angle in a range between 15 and 75 degrees from a lateral axis. In still other cases, some grooves of plurality of diagonal flex grooves 260 can be disposed at an angle in a range between 40 and 50 degrees from a lateral axis.

In some embodiments, plurality of diagonal flex grooves 260 may comprise first diagonal flex groove set 264 and second diagonal flex groove set 266. First diagonal flex groove set 264 may include diagonal flex grooves with medial end portions that are disposed closer to forward edge 222 and lateral end portions that are disposed closer to rearward edge 220. In contrast, second diagonal flex groove set 266 may include diagonal flex grooves with lateral end portions that are disposed closer to forward edge 222 and medial end portions that are disposed closer to rearward edge 220. In other words, the diagonal flex grooves of first diagonal flex groove set 264 may approach forward edge 222 as they move from lateral edge 230 to medial edge 232. Likewise, the diagonal flex grooves of second diagonal flex groove set 266 may approach forward edge 222 as they move from medial edge 232 to lateral edge 230.

In some embodiments, first diagonal flex groove set 264 may be configured to intersect with second diagonal flex groove set 266. In some cases, first diagonal flex groove set 264 and second diagonal flex groove set 266 may be configured to intersect in an approximately rectilinear manner. In other words, grooves may intersect at approximately 90 degree angles. In other cases, first diagonal flex groove set 264 and second diagonal flex groove set 266 may be configured to intersect at any other angles.

A flex groove set including diagonal flex grooves as well as longitudinal flex grooves and lateral flex grooves can include provisions for increasing multi-directional flexibility of a sole structure. In embodiments with segments comprised of intersecting longitudinal flex grooves and lateral flex grooves, diagonal flex grooves can be configured to intersect the corners of the segments.

Figure 2:
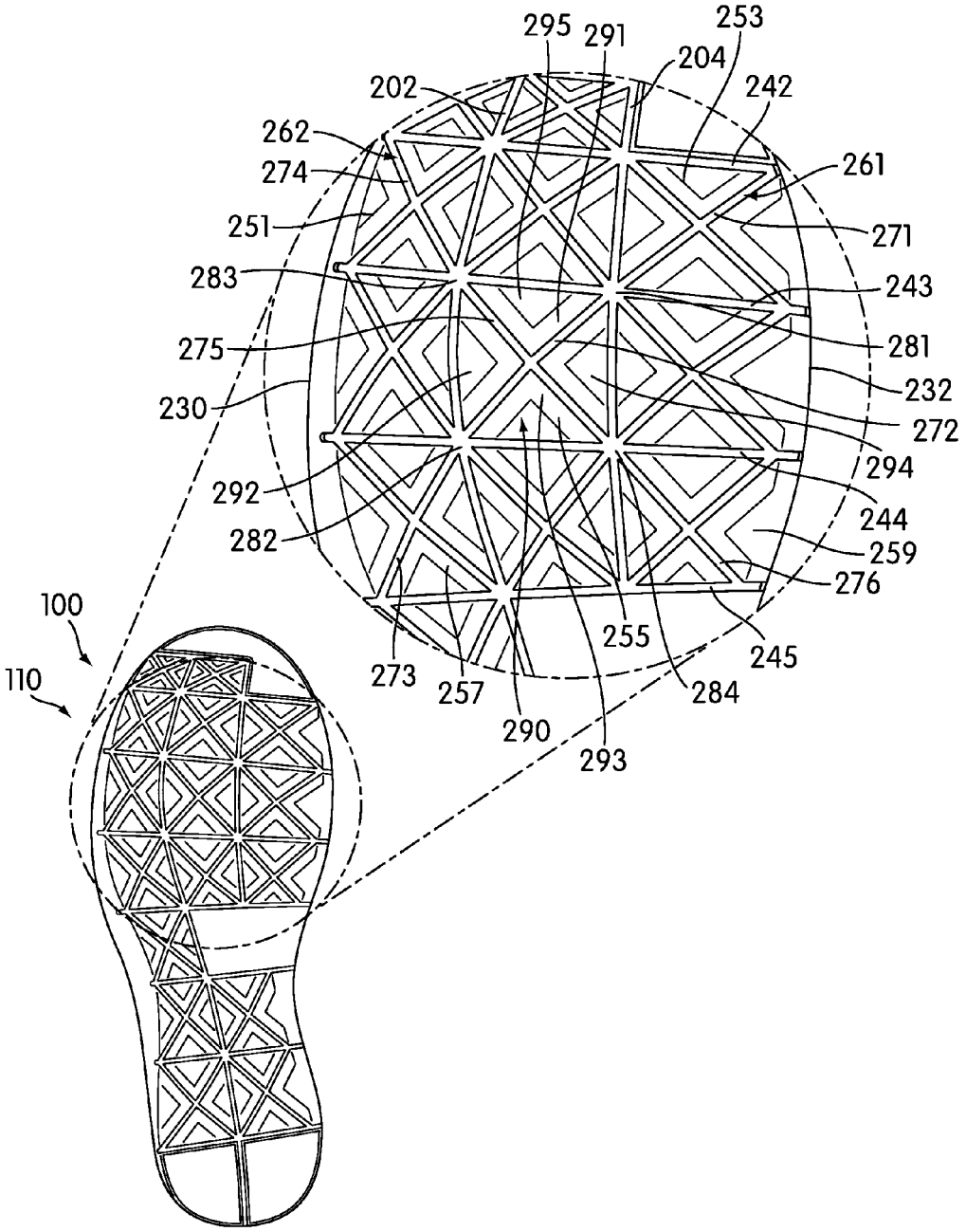
FIG. 2 is an enlarged view of an embodiment of an article of footwear including a sole structure with a flex groove system.

Referring to FIGS. 1 and 2, one or more segments of plurality of segments 250 may be associated with portions of a diagonal flex groove. In the current embodiment, plurality of diagonal flex grooves 260 includes first diagonal flex groove 261 that extends from medial edge 232 of second lateral flex groove 242 to lateral edge 230 of fifth lateral flex groove 245. In particular, first diagonal flex groove 261 intersects second longitudinal flex groove 204 and third lateral flex groove 243 at first intersection 281. Additionally, first diagonal flex groove 261 intersects first longitudinal flex groove 202 and fourth lateral flex groove 244 at second intersection 282. First intersection 281 and second intersection 282 may divide first diagonal flex groove 261 into first portion 271, second portion 272 and third portion 273. First portion 271 may extend through third segment 253. In particular, first portion 271 may extend from first intersection 281 to the intersection of second lateral flex groove 242 with medial edge 232. Second portion 272 may extend through fifth segment 275. In particular, second portion 272 may extend from first intersection 281 to second intersection 282, which are associated with opposing corners of fifth segment 255. Third portion 273 may extend through seventh segment 257. In particular, third portion 273 may extend from second intersection 282 to the intersection of fifth lateral flex groove 245 with lateral edge 230.

In some embodiments, plurality of diagonal flex grooves 260 includes second diagonal flex groove 262 that extends from lateral edge 230 of second lateral flex groove 242 to medial edge 232 of fifth lateral flex groove 245. In particular, second diagonal flex groove 262 intersects first longitudinal flex groove 202 and third lateral flex groove 243 at third intersection 283. Additionally, second diagonal flex groove 262 intersects second longitudinal flex groove 204 and fourth lateral flex groove 244 at fourth intersection 284. Third intersection 283 and fourth intersection 284 may divide second diagonal flex groove 262 into fourth portion 274, fifth portion 275 and sixth portion 276. Fourth portion 274 may extend through first segment 251. In particular, fourth portion 274 may extend from third intersection 283 to the intersection of second lateral flex groove 242 with lateral edge 230. Fifth portion 275 may extend through fifth segment 255. In particular, fifth portion 275 may extend from third intersection 283 to fourth intersection 284, which are associated with opposing corners of fifth segment 255. Sixth portion 276 may extend through ninth segment 259. In particular, sixth portion 276 may extend from fourth intersection 284 to the intersection of fifth lateral flex groove 245 with medial edge 232.

In a similar manner, each diagonal flex groove of plurality of diagonal flex grooves 260 may be configured to extend between intersections of first longitudinal flex groove 202, second longitudinal flex groove 204 and lateral flex groove set 240. In other words, each diagonal flex groove of plurality of diagonal flex grooves 260 may extend between opposing corners of segments.

In some embodiments, each segment of plurality of segments 250 may be associated with a cross-like pattern. For example, in this embodiment, fifth segment 255 is associated with second portion 272 and fifth portion 275 that form a substantially cross-like pattern within fifth segment 255. In a similar manner, the remaining segments may include portions of intersecting diagonal flex grooves that have substantially cross-like patterns.

In some embodiments, the cross-like pattern formed by intersecting diagonal flex grooves may further divide sole structure 110 into various portions. In some cases, sole structure 110 may further include plurality of portions 290 that are formed by the intersections of longitudinal flex grooves, lateral flex grooves and diagonal flex grooves. For example, in the current embodiment, second portion 272 and fifth portion 275 may further divide fifth segment 255 into first portion 291, second portion 292, third portion 293 and fourth portion 294. With this arrangement, plurality of portions 290 may be configured to articulate with respect to one another.

In different embodiments, the shapes of one or more portions of plurality of portions 290 may vary. In some cases, a portion can have a substantially triangular shape. In other cases, a portion can have any other shape including, but not limited to, rectangular shapes, rounded shapes, polygonal shapes, regular shapes, irregular shapes as well as any other types of shapes. In some cases, the shapes of a portion may be determined by the number of flex grooves bounding the portion. For example, in the current embodiment, each portion of plurality of portions 290 is bounded by three flex grooves and therefore each portion of plurality of portions 290 has a substantially triangular shape.

In some embodiments, plurality of portions 290 may comprise tread elements for sole structure 110. In some cases, plurality of portions 290 may include one or more recessed portions. For example, in this embodiment, first portion 291 can include first recessed portion 295. In a similar manner, the remaining portions of plurality of portions 290 can include similar recessed portions. With this arrangement, plurality of portions 290 can be configured to enhance the traction of sole structure 110.

In different embodiments, the depths of one or more flex grooves of a flex groove system can vary. For example, in one embodiment, each longitudinal flex groove, lateral flex groove and diagonal flex groove of a flex groove system can be associated with substantially similar depths. In another embodiment, each longitudinal flex groove and each lateral flex groove can be associated with a first depth, while each diagonal flex groove can be associated with a second depth. In some cases, the first depth could be greater than the second depth. In other cases, the second depth could be greater than the first depth. In other words, the diagonal flex grooves could have substantially different depths from the longitudinal flex grooves and the lateral flex grooves. In still another embodiment, each longitudinal flex groove could be substantially deeper than both the lateral flex grooves and the diagonal flex grooves. Furthermore, in some cases, a flex grooves system can be provided with longitudinal flex grooves having different depths. Also, in some cases, a flex groove system can be provided with lateral flex grooves having different depths. Still further, in some cases, a flex groove system can be provided with diagonal flex grooves having different depths. In addition, in some cases, each groove of a flex groove system can have a depth that varies in a longitudinal, lateral and/or diagonal direction.

By varying the depths of each type of flex groove, a flex groove system can be tuned to provide particular types of flexibility. For example, in embodiments where lateral flex grooves are deeper than longitudinal and diagonal flex grooves, the sole structure can be configured to enhance bending about a lateral axis to help with situations where an athlete may need to arch the foot. Likewise, in embodiments where diagonal flex grooves are deeper than longitudinal and lateral flex grooves, the sole structure can be configured to enhance bending about a diagonal axis, which can enhance torsion to help facilitate natural motions of the foot during running. In other embodiments, the depths of each type of groove may be tuned to accommodate multi-directional flexing so that the sole structure can bend in multiple different directions substantially simultaneously.

Figure 3:
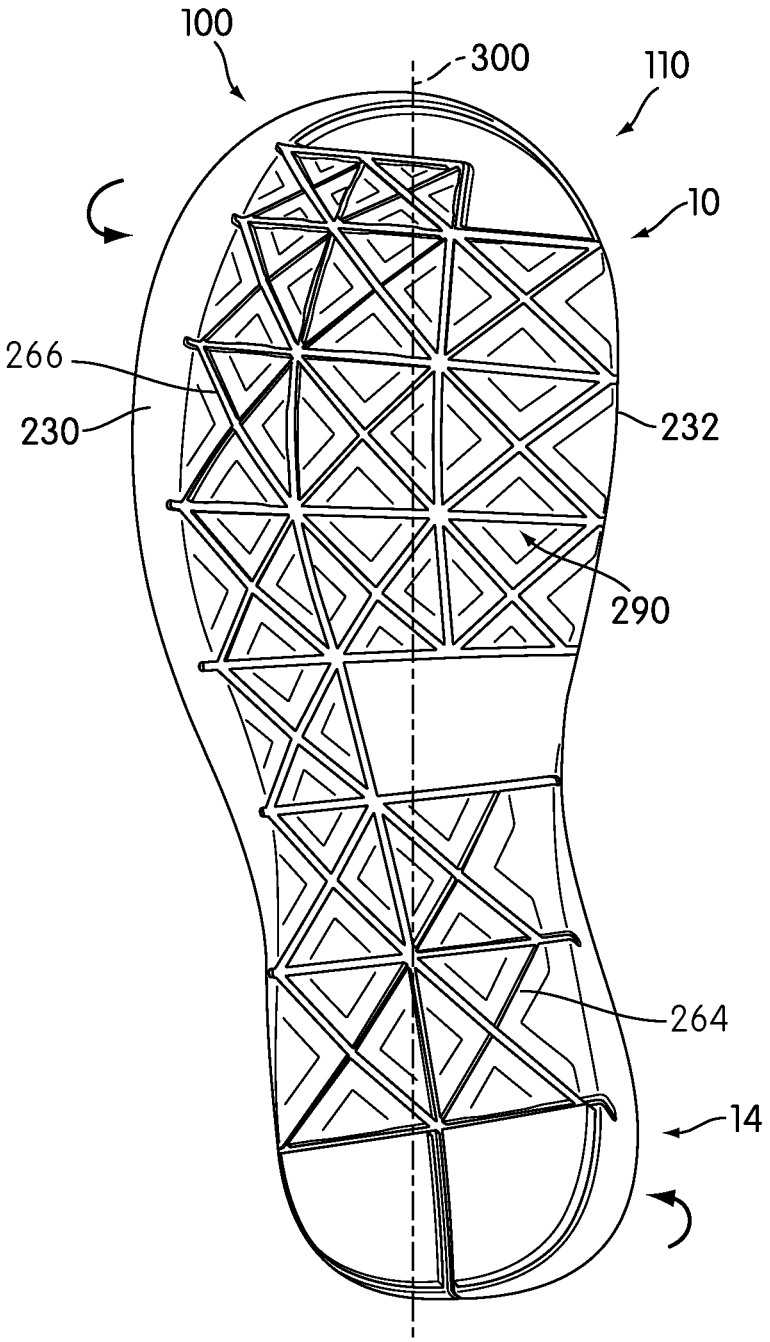
FIG. 3 is an isometric view of an embodiment of an article of footwear undergoing torsion.
Figure 4:
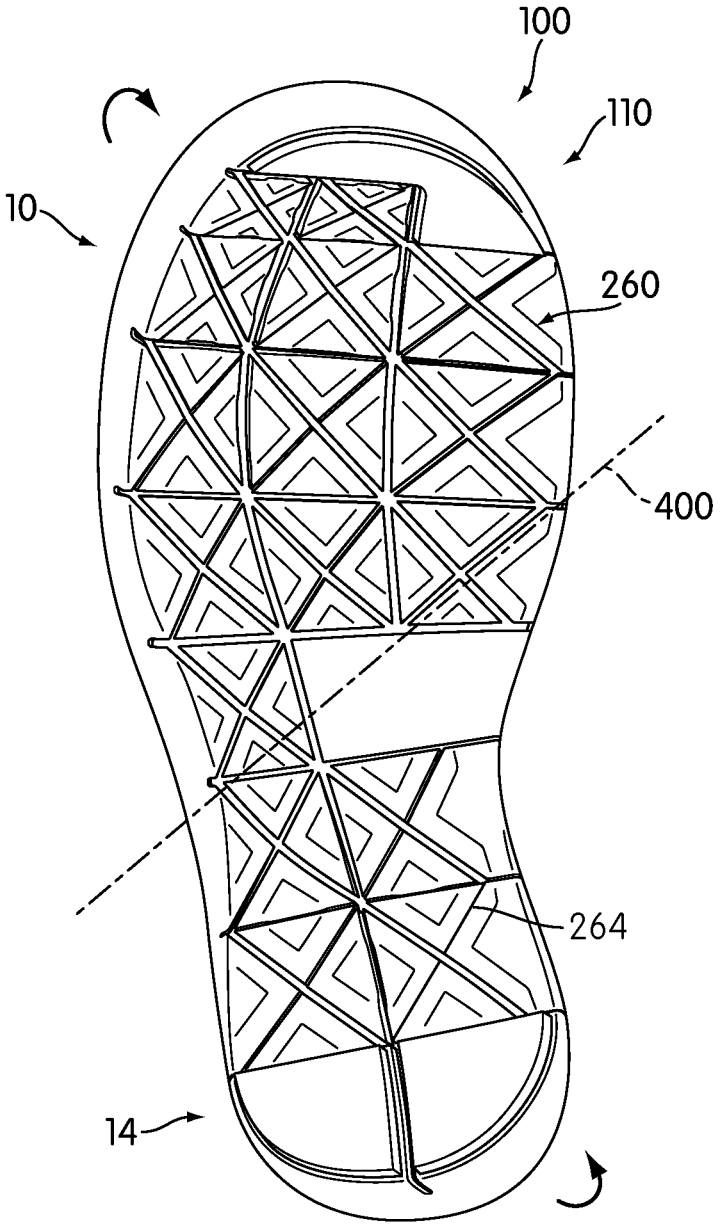
FIG. 4 is an isometric view of an embodiment of an article of footwear undergoing bending.

FIGS. 3 and 4 illustrate embodiments of sole structure 110 undergoing various types of flexing. In particular, FIG. 3 illustrates an embodiment of sole structure 110 undergoing twisting, while FIG. 4 illustrates an embodiment of sole structure 110 undergoing bending about a diagonal axis.

Referring to FIG. 3, sole structure 110 is associated with longitudinal axis 300. In this embodiment, a clockwise torque about longitudinal axis 300 is applied to lateral edge 230 of forefoot portion 10. Also, a counterclockwise torque about longitudinal axis 300 is applied to medial edge 232 of heel portion 14. As these two forces are applied substantially simultaneously, sole structure 110 experiences torsion, or twisting, about longitudinal axis 300.

Using the arrangement for sole structure 110 discussed above, sole structure 110 may be configured to twist substantially under the applied torques. Since sole structure 110 may be associated with plurality of portions 290 that can articulate with respect to one another, forefoot portion 10 and heel portion 14 can both be twisted without undergoing substantial plastic deformation or structural failure. Furthermore, plurality of diagonal flex grooves 260 may enhance the ability of sole structure 110 to twist at forefoot portion 10 and heel portion 14. For example, in the current embodiment, plurality of diagonal flex grooves 260 are configured to flex as sole structure 110 undergoes twisting. In particular, some flex grooves of first diagonal flex groove set 264 may be pinched together, while some grooves of second diagonal flex groove set 266 may remain wide open to allow stretching between adjacent portions of sole structure 110.

By enhancing torsion in sole structure 110, an article can be configured to help a user maintain stability during various types of activities where torsion can occur. For example, during lateral maneuvers, a medial or lateral edge of sole structure 110 may contact a ground surface initially. The ground may apply a torque to the medial or lateral edge which can cause sole structure 110 to twist. Using the arrangement described above, sole structure 110 may twist in a controlled manner to provide a smoother transition as the rest of sole structure 110 continues to contact the ground.

Referring to FIG. 4, sole structure 110 may be associated with diagonal axis 400. In this embodiment, bending forces may be applied to sole structure 110 in a manner that bends sole structure 110 about diagonal axis 400. Using the arrangement for sole structure 110 discussed above, sole structure 110 may be configured to bend substantially. In particular, some grooves of plurality of diagonal flex grooves 260 may be pinched together, which can help facilitate bending about diagonal axis 400. In this embodiment, many grooves of first diagonal flex groove set 264 are pinched together. This arrangement allows forefoot portion 10 and heel portion 14 to bend substantially without undergoing substantial plastic deformation or structural failure.

By enhancing diagonal bending in sole structure 110, an article can be configured to help maintain stability during various types of activities where bending, especially bending along a diagonal axis, can occur. For example, in situations where a user is running up a staircase, as occurs in various types of athletic training, the corner of an article can catch against the wall of the next step to be ascended. Using the arrangement discussed above, the corner of sole structure 110 can easily bend about a diagonal axis to help prevent the corner from catching against the step and causing a user to trip.

The arrangement discussed for flex groove system 200 can provide sole structure 110 with enhanced multi-directional flexibility, especially over traditional flex groove systems. As previously discussed, since each diagonal flex groove extends between intersections of longitudinal flex grooves and lateral flex grooves, different regions of sole structure 110 can articulate independently to provide enhanced adaptability for sole structure 110.

Figure 5:
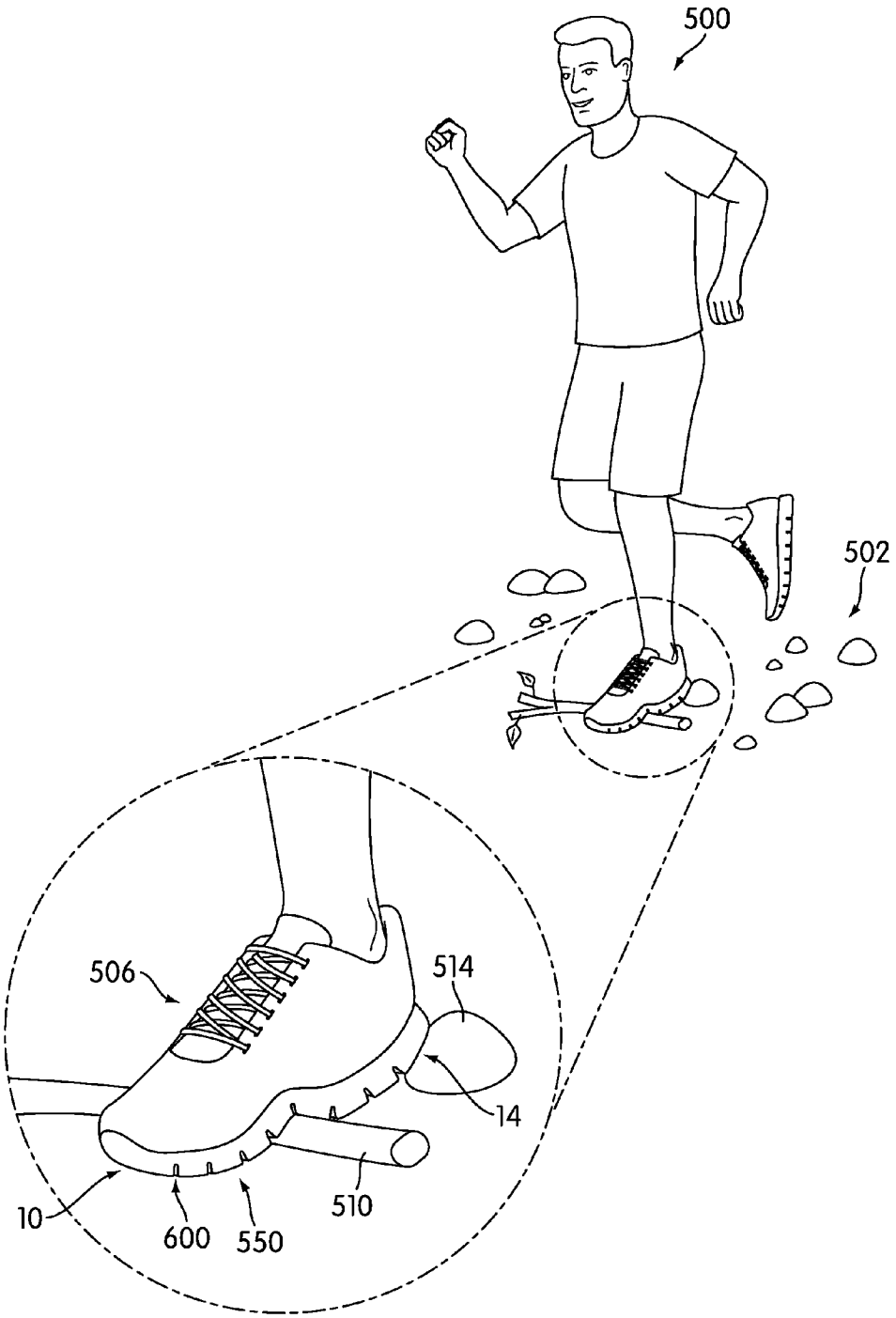
FIG. 5 is an isometric view of an embodiment of a user running on a trail.
Figure 6:
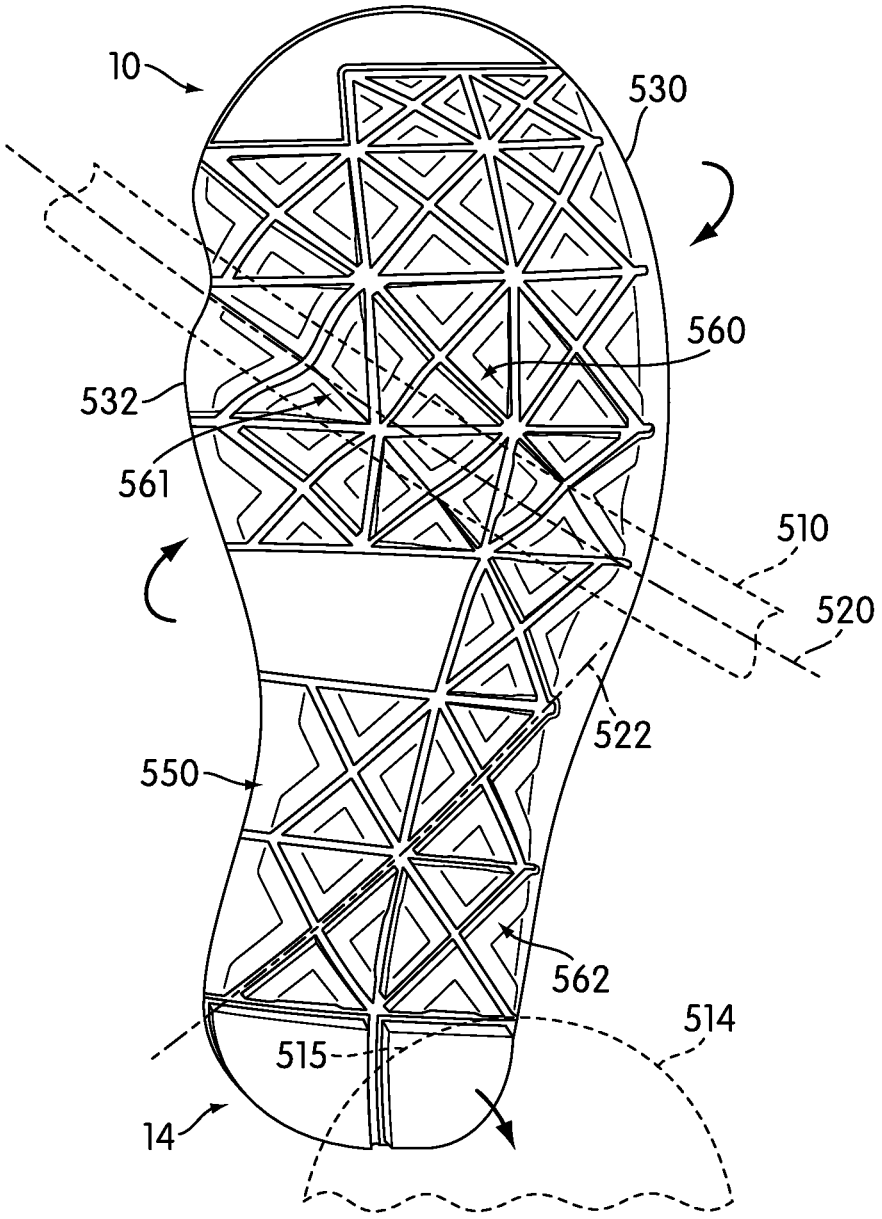
FIG. 6 is an enlarged view of an embodiment of an article of footwear flexing in multiple directions due to an uneven trail surface.

FIGS. 5 and 6 illustrate an embodiment of sole structure 110 simultaneously flexing in multiple directions. Referring to FIGS. 5 and 6, user 500 is running along trail 502. In this case, trail 502 may be an outdoor running trail, which are commonly used in cross-country type training. In some situations, running trails may provide uneven surfaces for runners. For example, sticks, rocks, bumps, and other objects, could be disposed on various sections of a trail. In this embodiment, as user 500 takes a step forward, article 506 may land on top of both stick 510 and rock 514 simultaneously. In particular, forefoot portion 10 may contact stick 510, while heel portion 14 may contact rock 514.

As the running motion of user 500 continues, weight may be transferred onto article 506. At this point, sole structure 110 may be pressed downwards against stick 510 and rock 514 at the same time. In the current embodiment, article 506 is provided with sole structure 550. In particular, sole structure 550 may be substantially similar to sole structure 110 of the embodiments discussed above and sole structure 550 may be provided with flex groove system 600. With this arrangement, sole structure 550 may be configured to flex substantially to adapt to the uneven surfaces of stick 510 and rock 514.

In one embodiment, as forefoot portion 10 is depressed against stick 510, forefoot portion 10 can be configured to conform to stick 510. In this case, stick 510 may be oriented in a substantially diagonal direction with respect to sole structure 550. Therefore, as weight is applied across forefoot portion 10, medial edge 532 and lateral edge 530 of sole structure 550 may bend downwards about first diagonal axis 520 that is approximately parallel with stick 510. In particular, plurality of diagonal flex grooves 560 allow forefoot portion 10 to flex around stick 510.

Also, as heel portion 14 is depressed against edge 515 of rock 514, heel portion 14 can be configured to bend upwards. In this case, edge 515 may be oriented in a substantially diagonal direction with respect to sole structure 550. Therefore, as weight is applied across heel portion 14, medial edge 532 of heel portion 14 may bend upwards about second diagonal axis 522 that is approximately parallel with edge 515 of rock 514. In particular, plurality of diagonal flex grooves 560 allow heel portion 14 to bend about second diagonal axis 522.

Although first diagonal axis 520, which is parallel with stick 510 and second diagonal axis 522, which is parallel with edge 515 of rock 514, are oriented in substantially different directions, the arrangement of flex groove system 600 allows for substantially simultaneous flexing of sole structure 110 in different directions. In particular, first diagonal flex groove set 561 is oriented in a manner to facilitate flexing about first diagonal axis 520. Likewise, second diagonal flex groove set 562 is oriented in a manner to facilitate flexing about second diagonal axis 522.

It will be understood that the embodiment discussed and illustrated in FIGS. 5 and 6 is only intended as one possible example of multi-directional flexing. Generally, the arrangement for a flex groove system discussed in this detailed description can allow for multi-directional flexing of a sole structure in a variety of different situations. For example, using the flex groove system discussed above, a sole structure can be configured to conform to substantially any type of uneven surface to help a user maintain stability during walking, running, jumping or other types of motion.

Figure 7:
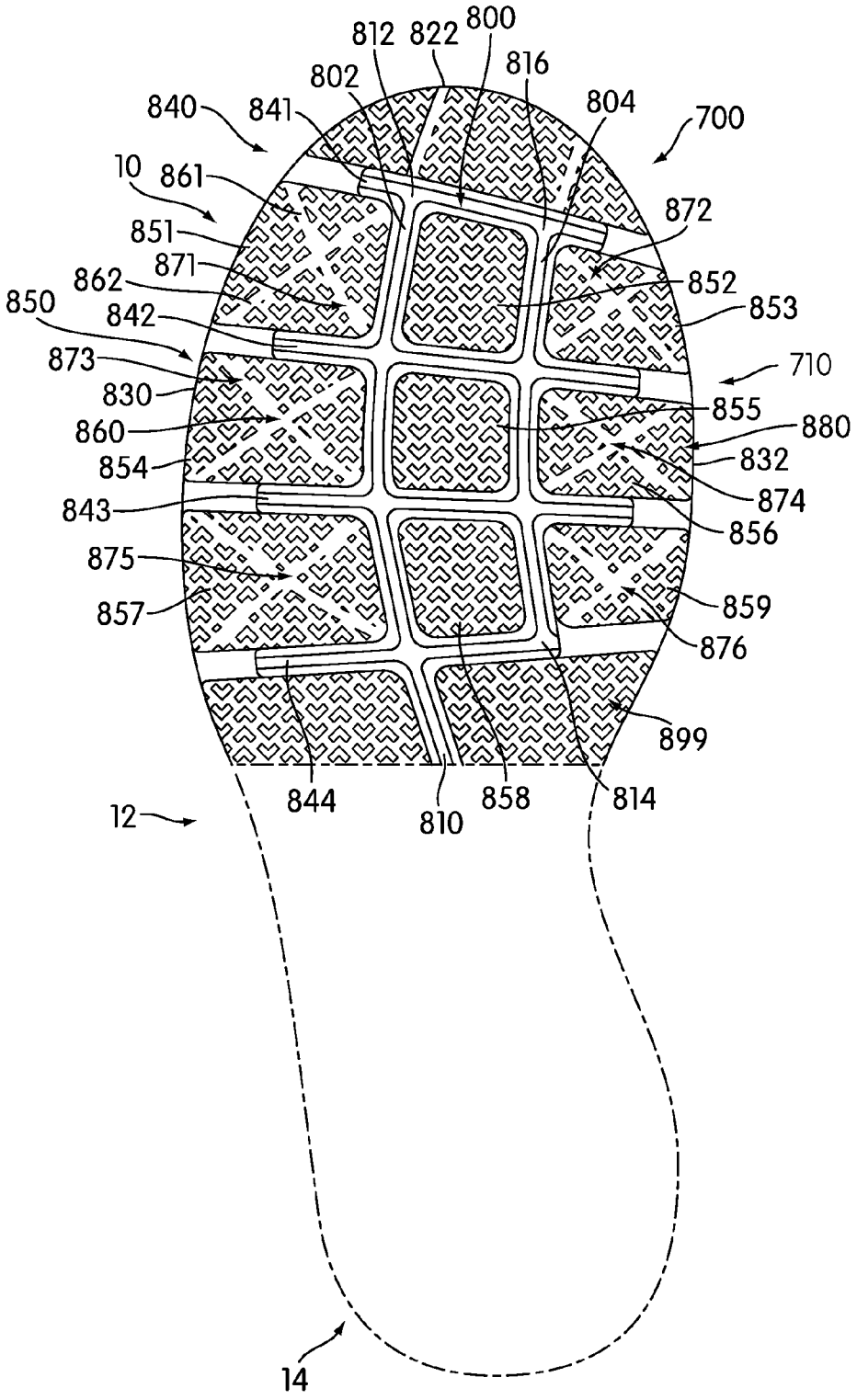
FIG. 7 is a plan view of an embodiment of an article of footwear including a sole structure with a flex groove system.

FIG. 7 illustrates another embodiment of a flex groove system for a sole structure. In this embodiment, article 700 can include sole structure 710. In an exemplary embodiment, article 700 and sole structure 710 can be similar to article 100 and sole structure 110 of the previous embodiment.

Sole structure 710 can include flex groove system 800. Generally, flex groove system 800 can include a plurality of flex grooves disposed on one or more portions of sole structure 710. In some cases, flex groove system 800 may be associated with forefoot portion 10 of sole structure 710. In other cases, flex groove system 800 may be associated with midfoot portion 12 of sole structure 710. In still other cases, flex groove system 800 may be associated with heel portion 14 of sole structure 710. In an exemplary embodiment, flex groove system 800 may be configured to extend through just forefoot portion 10.

Flex groove system 800 can include first longitudinal flex groove 802 and second longitudinal flex groove 804. In some cases, first longitudinal flex groove 802 may include first end portion 810 that is disposed adjacent to midfoot portion 12. In addition, first longitudinal flex groove 802 may include second end portion 812 that is disposed adjacent to forward edge 822 of forefoot portion 10. Likewise, second longitudinal flex groove 804 may include first end portion 814 that is disposed adjacent to midfoot portion 12. In addition, second longitudinal flex groove 804 may include second end portion 816 that is disposed adjacent to forward edge 822 of forefoot portion 10. With this arrangement, first longitudinal flex groove 802 and second longitudinal flex groove 804 can provide substantial flexibility for sole structure 710 about a longitudinal axis of article 700.

Flex groove system 800 can include lateral flex groove set 840 that comprises first lateral flex groove 841, second lateral flex groove 842, third lateral flex groove 843 and fourth lateral flex groove 844. In some cases, each flex groove of lateral flex groove set 840 may extend from lateral edge 830 of sole structure 710 to medial edge 832 of sole structure 710. In other embodiments, one or more flex grooves of lateral flex groove set 840 may not extend over the entire width of sole structure 710. With this arrangement, the flex grooves of lateral flex groove set 840 can provide substantial flexibility for sole structure 710 about a lateral axis of article 700.

In a similar manner to the arrangement discussed above, first longitudinal flex groove 802, second longitudinal flex groove 804 and lateral flex groove set 840 can divide sole structure 710 into plurality of segments 850. In this embodiment, sole structure 710 may be divided into first segment 851, second segment 852, third segment 853, fourth segment 854, fifth segment 855, sixth segment 856, seventh segment 857, eighth segment 858 and ninth segment 859. With this arrangement, bottom surface 899 of sole structure 710 can be provided with segments that are configured to flex substantially independently of one another.

Sole structure 710 can also include plurality of tread elements 880. In some cases, plurality of tread elements 880 can be raised with respect to bottom surface 899 of sole structure 710. In an exemplary embodiment, plurality of tread elements 880 can be molded tread elements that are integrally formed with bottom surface 899. This arrangement allows plurality of tread elements 880 to provide increased traction for bottom surface 899.

In embodiments where a sole structure includes a plurality of tread elements, a flex groove system can include provisions for modifying the arrangement of the tread elements to enhance flexibility for the sole structure. In some embodiments, flex groove system 800 can include plurality of diagonal flex grooves 860 that are associated with plurality of tread elements 880. For example, first segment 851 may include first diagonal flex groove 861 and second diagonal flex groove 862. In this embodiment, first diagonal flex groove 861 extends between the intersection of second lateral flex groove 842 with first longitudinal flex groove 802 and the intersection of first lateral flex groove 841 with lateral edge 830. In a similar manner, second diagonal flex groove 862 extends between the intersection of first lateral flex groove 841 with first longitudinal flex groove 802 and the intersection of second lateral flex groove 842 with lateral edge 830. In other words, first diagonal flex groove 861 and second diagonal flex groove 862 extend between opposing corners of first segment 851. Furthermore, first diagonal flex groove 861 and second diagonal flex groove 862 comprise first cross-like pattern 871.

In a similar manner, plurality of diagonal flex grooves 860 comprise second cross-like pattern 872, third cross-like pattern 873, fourth cross-like pattern 874, fifth cross-like pattern 875 and sixth cross-like pattern 876 that correspond to third segment 853, fourth segment 854, sixth segment 856, seventh segment 857 and ninth segment 859, respectively. Each of these cross-like patterns comprises two intersecting diagonal flex grooves that are configured to extend between opposing corners of a segment. Furthermore, each of these cross-like patterns include diagonal flex grooves that extend to the intersections between first longitudinal flex groove 802, second longitudinal flex groove 804 and lateral flex groove set 840. With this arrangement, plurality of diagonal flex grooves 860 can provide increased flexibility for sole structure 710, especially along various diagonal axes that are parallel to one or more of the diagonal flex grooves of plurality of diagonal flex grooves 860.

In this embodiment, the depth of plurality of diagonal flex grooves 860 may be substantially different from the depth of first longitudinal flex groove 802, second longitudinal flex groove 804 and lateral flex groove set 840. In particular, while first longitudinal flex groove 802, second longitudinal flex groove 804 and lateral flex groove set 840 may be grooves formed in bottom surface 899 of sole structure 710, the depth of plurality of diagonal flex grooves 860 may be determined according to the height of plurality of tread elements 880. In this case, plurality of diagonal flex grooves 860 may be substantially shallower than the depths of first longitudinal flex groove 802, second longitudinal flex groove 804 and lateral flex groove set 840. With this arrangement, flex groove system 800 may be configured to primarily provide longitudinal and lateral flexibility with some degree of diagonal flexibility. In other embodiments, however, the depth of one or more grooves of flex groove system 800 can vary substantially. By varying the depths of one or more grooves, the overall flexibility of sole structure 710, including multi-directional flexibility, can be fine tuned.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear comprising:

a sole structure including a longitudinal direction associated with a length of the sole structure and the sole structure including a lateral direction associated with a width of the sole structure;

a first longitudinal flex groove and a second longitudinal flex groove extending in the longitudinal direction, wherein the second longitudinal flex groove is disposed adjacent to the first longitudinal flex groove with no other longitudinal flex groove disposed between the first longitudinal flex groove and the second longitudinal flex groove, and wherein the first longitudinal flex groove is disposed towards a lateral edge of the sole structure and the second longitudinal flex groove is disposed towards a medial edge of the sole structure;

a lateral flex groove set comprising a first lateral flex groove and a second lateral flex groove extending in the lateral direction, wherein the first lateral flex groove is disposed adjacent to the second lateral flex groove with no other lateral flex grooves disposed between the first lateral flex groove and the second lateral flex groove, wherein the first lateral flex groove terminates approximately midway between the first longitudinal flex groove and the lateral edge of the sole structure with no other lateral flex groove disposed between the first lateral flex groove and the lateral edge of the sole structure; and the first lateral flex groove terminates approximately midway between the second longitudinal flex groove and the medial edge of the sole structure with no other lateral flex groove disposed between the first lateral flex groove and the medial edge of the sole structure;

the first longitudinal flex groove intersecting the first lateral flex groove at a first intersection and the first longitudinal flex groove intersecting the second lateral flex groove at a second intersection;

a first diagonal flex groove being oriented in a direction between the longitudinal direction, the first diagonal flex groove extending from the first intersection to a lateral edge of the sole structure;

a second diagonal flex groove being oriented in a direction between the longitudinal direction and the lateral direction, the second diagonal flex groove extending from the second intersection to a lateral edge of the sole structure; and wherein the first diagonal flex groove is configured to intersect with the second diagonal flex groove in an approximately rectilinear manner.

2. The article of footwear according to claim 1, wherein the first longitudinal flex groove, the second longitudinal flex groove and the lateral flex groove set are disposed on a forefoot portion of the sole structure.

3. The article of footwear according to claim 1, wherein each of the first longitudinal flex groove, the second longitudinal flex groove, the first lateral flex groove and the second lateral flex groove terminate inward from an outer edge of the sole structure, with no other flex grooves disposed between the termination and the outer edge of the sole structure.

4. The article of footwear according to claim 1, wherein the first longitudinal flex groove, the second longitudinal flex groove and the lateral flex groove set are formed in a bottom surface of the sole structure.

5. The article of footwear according to claim 1, wherein a plurality of tread elements are formed on a bottom surface of the sole structure, the plurality of tread elements being raised with respect to the bottom surface of the sole structure, and wherein the first diagonal flex groove and the second diagonal flex groove are defined in the plurality of tread elements, a depth of the first diagonal flex groove and a depth of the second diagonal flex groove being equal to a height of the plurality of tread elements.

6. The article of footwear according to claim 1, wherein the lateral flex groove set further comprises a third lateral flex groove and a fourth lateral flex groove extending in the lateral direction, wherein the third lateral flex groove is disposed adjacent to the second lateral flex groove and the fourth lateral flex groove with no other lateral flex grooves disposed between the second lateral flex groove, the third lateral flex groove and the fourth lateral flex groove.

7. The article of footwear according to claim 6, wherein:

the second longitudinal flex groove extends from an intersection with the first lateral flex groove to an intersection with the fourth lateral flex groove; and the fourth lateral flex groove extends from an end portion disposed on a lateral portion of the sole structure between the lateral edge of the sole structure and the first longitudinal flex groove to an intersection with the second longitudinal flex groove.

8. An article of footwear comprising:

a sole structure including a longitudinal direction associated with a length of the sole structure, a lateral direction associated with a width of the sole structure, the sole structure comprising a flex groove system configured to provide flexibility in the longitudinal direction and the lateral direction, the flex groove system comprising:

a first longitudinal flex groove extending in the longitudinal direction from a forefoot portion of the sole structure to a midfoot portion of the sole structure and having a first depth;

a second longitudinal flex groove extending in the longitudinal direction from the forefoot portion of the sole structure to the midfoot portion of the sole structure and having the first depth;

a lateral flex groove set including a first lateral flex groove and a second lateral flex groove extending in the lateral direction, the lateral flex groove set having a second depth;

the first longitudinal flex groove intersecting the first lateral flex groove at a first intersection and the first longitudinal flex groove intersecting the second lateral flex groove at a second intersection;

the first lateral flex groove including a first end portion disposed on a lateral portion of the sole structure between a lateral edge of the sole structure and the first intersection;

the second lateral flex groove including a first end portion disposed on the lateral portion of the sole structure between the lateral edge of the sole structure and the second intersection;

a first diagonal flex groove having a third depth, the first diagonal flex groove being oriented in a direction between the longitudinal direction and the lateral direction;

a second diagonal flex groove having the third depth, the second diagonal flex groove being oriented in a direction between the longitudinal direction and the lateral direction;

wherein the first diagonal flex groove extends from the first intersection to the lateral edge of the sole structure and the second diagonal flex groove extends from the second intersection to the lateral edge of the sole structure, the first diagonal flex groove and the second diagonal flex groove forming a cross-like pattern;

wherein the third depth is different than the first depth and the second depth; and wherein the intersections of the first longitudinal flex groove, the second longitudinal flex groove and the lateral flex groove set define a plurality of segments configured to flex independently of each other.

9. The article of footwear according to claim 8, wherein each of the first longitudinal flex groove, the second longitudinal flex groove and the lateral flex groove set terminate inward from an edge of the sole structure.

10. The article of footwear according to claim 8, wherein the first longitudinal flex groove, the second longitudinal flex groove and the lateral flex groove set are formed in a bottom surface of the sole structure.

11. The article of footwear according to claim 10, wherein a plurality of tread elements are formed on the bottom surface of the sole structure, the plurality of tread elements being raised with respect to the bottom surface of the sole structure, and wherein the first diagonal flex groove and the second diagonal flex groove are defined in the plurality of tread elements, the third depth being equal to a height of the plurality of tread elements.

12. The article of footwear according to claim 8, wherein the third depth is substantially shallower than the first depth and the second depth.

13. An article of footwear comprising:

a sole structure including a longitudinal direction associated with a length of the sole structure and the sole structure including a lateral direction associated with a width of the sole structure;

a first longitudinal flex groove and a second longitudinal flex groove extending in the longitudinal direction, wherein the second longitudinal flex groove is disposed adjacent to the first longitudinal flex groove with no other longitudinal flex groove disposed between the first longitudinal flex groove and the second longitudinal flex groove;

a lateral flex groove set comprising a first lateral flex groove and a second lateral flex groove extending in the lateral direction and wherein the first lateral flex groove is disposed adjacent to the second lateral flex groove with no other lateral flex grooves disposed between the first lateral flex groove and the second lateral flex groove;

a segment bounded by intersections of the first longitudinal flex groove with the first lateral flex groove and the second lateral flex groove and by intersections of the second longitudinal flex groove with the first lateral flex groove and the second lateral flex groove;

a plurality of separately formed v-shaped tread elements disposed on the segment, the plurality of v-shaped tread elements each being separated from a neighboring v-shaped tread element by a space and being raised with respect to a bottom surface of the sole structure; and a diagonal flex groove set forming a cross-like pattern, the diagonal flex groove set comprising a first diagonal flex groove and a second diagonal flex groove formed on the segment through the plurality of v-shaped tread elements, the diagonal flex groove set having a depth equal to a height of the plurality of v-shaped tread elements.

14. The article of footwear according to claim 13, wherein the article comprises at least two longitudinal flex grooves and the lateral flex groove set comprises at least four lateral flex grooves.

15. The article of footwear according to claim 14, wherein the article includes a plurality of segments bounded by intersections of the at least two longitudinal flex grooves, a lateral edge of the sole structure, a medial edge of the sole structure and the lateral flex groove set.

16. The article of footwear according to claim 15, wherein each segment of the plurality of segments includes a plurality of v-shaped tread elements disposed on the segment, the plurality of v-shaped tread elements being raised with respect to the bottom surface of the sole structure.

17. The article of footwear according to claim 15, wherein each segment in a first subset of the plurality of segments bordering the lateral edge of the sole structure and each segment in a second subset of the plurality of segments bordering the medial edge of the sole structure includes a diagonal flex groove set dividing each segment in the first subset and the second subset into four portions.

18. The article of footwear according to claim 17, wherein each of the four portions of each segment in the first subset and the second subset include a plurality of v-shaped tread elements disposed on the segment, the plurality of v-shaped tread elements being raised with respect to the bottom surface of the sole structure.

19. The article of footwear according to claim 13, wherein the plurality of v-shaped tread elements further comprises:

a first row of v-shaped tread elements extending in the longitudinal direction;

a second row of v-shaped tread elements extending in the longitudinal direction, wherein the second row of v-shaped tread elements is disposed adjacent to the first row of v-shaped tread elements with no other v-shaped tread elements disposed between the first row of v-shaped tread elements and the second row of v-shaped tread elements; and wherein the first row of v-shaped tread elements and the second row of v-shaped tread elements are oriented in opposite directions.

20. The article of footwear according to claim 13, wherein the plurality of tread elements are molded tread elements and are integrally formed with the bottom surface of the sole structure.

* * * * *